US006021546A

United States Patent [19]

Tyma

[11] Patent Number: 6,021,546

[45] Date of Patent: Feb. 8, 2000

[54] VACUUM CLEANING APPARATUS FOR CARPETS

[76] Inventor: Anthony J. Tyma, 6720 46th Ave. West, #C, Bradenton, Fla. 34210

[21] Appl. No.: 09/189,258

[22] Filed: Nov. 10, 1998

[51] Int. Cl.[7] ..... A47L 5/26

[52] U.S. Cl. ..... 15/388; 15/402

[58] Field of Search ..... 15/383, 388, 363, 15/366, 142, 236.1, 386, 402

[56] References Cited

U.S. PATENT DOCUMENTS

| | | | |
|---|---|---|---|
| 848,974 | 4/1907 | Crossman | 15/383 X |
| 1,191,999 | 7/1916 | Roever | 15/402 X |
| 2,051,203 | 8/1936 | Dow | 15/402 |
| 3,309,729 | 3/1967 | Dresser | 15/236.1 |
| 4,185,350 | 1/1980 | Fish | 15/236.1 |
| 4,363,157 | 12/1982 | McGrath | 15/388 |
| 4,903,369 | 2/1990 | Kitamura et al. | 15/388 X |
| 5,237,719 | 8/1993 | Dwyer, Jr. et al. . | |
| 5,287,591 | 2/1994 | Rench et al. . | |
| 5,307,538 | 5/1994 | Rench et al. . | |

*Primary Examiner*—Chris K. Moore
*Attorney, Agent, or Firm*—Charles J. Prescott

[57] ABSTRACT

A carpet vacuum cleaning machine and roller attachment apparatus therefor for cleaning and extracting dirt and debris deep below the surface of carpets. The carpet cleaning machine includes a vacuum head or housing operably connected to a vacuum source and a debris collecting member. The roller attachment apparatus preferably replaces the conventional elongated motor-driven roller brushes commonly used in most vacuum cleaning machines. The apparatus includes a plurality of spaced star-shaped spur discs mounted side-by-side for free rotation on an elongated support shaft. As the vacuum cleaning machine is moved across the carpet, the pointed periphery of each disc engages and penetrates into the carpet to separate the carpet fibers to expose dirt below the carpet upper surface thereby allowing more effective vacuum extraction of the dirt.

2 Claims, 3 Drawing Sheets

VACUUM CLEANING APPARATUS FOR CARPETS

BACKGROUND OF THE INVENTION

1. Scope of Invention

Generally, this invention is directed towards vacuum cleaners for use with carpeted surfaces. More specifically, this invention provides a vacuum carpet cleaning apparatus which penetrates deep into the carpet and thereby allowing debris from deep within the carpet to be vacuum extracted.

2. Prior Art

One of the problems noticed with typical vacuum cleaners using conventional motor driven roller brushes is that only debris and dirt from the surface area of the carpet is extracted. Dirt deep below the surface of the carpet fibers remains and is not affected by the rotating brushes. Moreover, the bristles of the roller brushes tend to beat down onto the carpet fibers thereby causing premature degradation of the carpet fibers and discoloration. Additionally, beating down on the carpet fibers by the vacuum roller brushes causes the carpet fibers to be compressed together thus further impeding dirt and debris from being removed from the below the surface of the carpeted floors.

Another problem with conventional vacuum cleaners is that the rotating brushes tend to get tangled with fibrous materials such as hair and string. These materials can quickly build up around the roller brush and exert additional load on the vacuum motor, possibly damaging the vacuum motor and requiring frequent replacement of vacuum cleaner belts due to excessive wear and tear.

Several approaches to this problem have been provided for vacuum cleaner designs and apparatus. In U.S. Pat. No. 5,307,538, an improved carpet cleaning machine intended for use with "dry" carpet cleaning systems using dampened granules or particles is disclosed which can be used in either or two modes. One mode involves carpet brushing for dirt removal by urging particles into the carpet and along the fibers. The other mode involves later vacuuming for particle removal. To facilitate the latter, one embodiment of the machine has first and second particle-removing media such as a concentrically-mounted cyclone separator and conical screen filter, respectively. The separator has air flowing through it downwardly along a vertical path and then upward, such air flow often carrying along a few particles. Such high-velocity particles impinge on the outer surface of the screen filter and many particles adhering to such filter are dislodged. The filter is said to thereby be "purged" or cleaned. There may also be a third medium and even a fourth medium to remove very fine particles before the air is expelled back into the room. Other embodiments use an automotive, resilient foam or flat-element filter medium in place of or in addition to the conical screen filter.

In the apparatus taught by U.S. Pat. No. 5,287,591, an improved machine convertible for brush-aided cleaning or vacuuming includes a pair of powered brushes counterrevolving for stroking solvent-dampened carpet cleaning particles through the carpet and along carpet fibers during initial cleaning. A separately powered pod is detachable from the machine during brush-aided carpet cleaning and attached to a machine-mounted vacuum nozzle for carpet vacuuming to pick up the dirt-laden particles. The pod has first and second media selected to remove particles of differing sizes from air flowing through the pod. During initial carpet cleaning when vacuum is not needed, the pod may be detached and used in another area for hand-vacuuming carpeted stairs and other "small-area" places.

In the art taught by U.S. Pat. No. 5,237,719, an improved cleaning apparatus for cleaning carpet, upholstery and the like includes a housing, a first storage tank for liquid cleaning solution, a dispensing pump for dispensing the cleaning solution to an area to be cleaned, a vacuum motor for suctioning excess cleaning solution and other material extracted from the area, and a second storage tank removably carried in the housing for accumulating excess cleaning fluid and other material extracted from the area. The respective upper portion of the first and second storage tanks extend above the housing when the first and second storage tanks are each equipped with a pair of handles to facilitate removal and replacement of the respective tanks. A quick disconnect fitting is provided for locating the first storage tank so that the first storage tank is in fluid communication with the dispensing pump. The quick disconnect fitting enables rapid removal of the first storage tank from the housing and facilitates reinstallation thereof.

While some of the prior art may contain some similarities relating to the present invention, none of them teach, suggest or include all of the advantages and unique features of a vacuum cleaning machine combined with a roller attachment apparatus including a plurality of free-rolling spurred or star-shaped disks for extracting dirt and debris from deep within the carpet fibers. For the foregoing reasons, there is a need for such an apparatus that can easily facilitate extraction of dirt and debris from deep inside the fibers of a carpet.

BRIEF SUMMARY OF THE INVENTION

The present invention is directed to an improved roller attachment apparatus for vacuum carpet cleaning machines used for cleaning carpets and rugs or surfaces having a material like surface. The roller apparatus, here sometimes referred to as a "spurshank" (a suggestive term coined by applicant), replaces the typical rotating bristle brushes that conventional vacuum cleaners normally carry. The apparatus includes a plurality of spaced apart somewhat star-shaped or spurred discs mounted for free, preferably independent rotation on a support shaft. The sharp pointed tips of each disc engage the carpeted surface and spread the nap of the carpet thereby exposing dirt and debris deep inside the carpet. The vacuum source of the vacuum cleaning machine is then able to extract the dirt and debris from deep inside the surface of the carpet.

Accordingly, it is an object of this invention to replace conventional motor-driven roller brushes of conventional vacuum cleaning machines with a spurshank apparatus that will spread the carpet nap and thereby allow dirt and debris to be vacuum extracted from depths of the carpet pile.

Another object of this invention is to provide a vacuum head attachment with a spurshank apparatus attached thereto thereby complimenting conventional carpet vacuum cleaning machines. This will allow conventional vacuum cleaners to remove dirt and debris from both the surface and in the depth of a carpet.

Still another object of this invention is to provide the spurshank apparatus in combination with a vacuum cleaning machine that will give the carpet a nice, textured feel after vacuuming.

Other objects and a fuller understanding of the invention will become apparent from reading the following detailed description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE INVENTION

Figure 1:
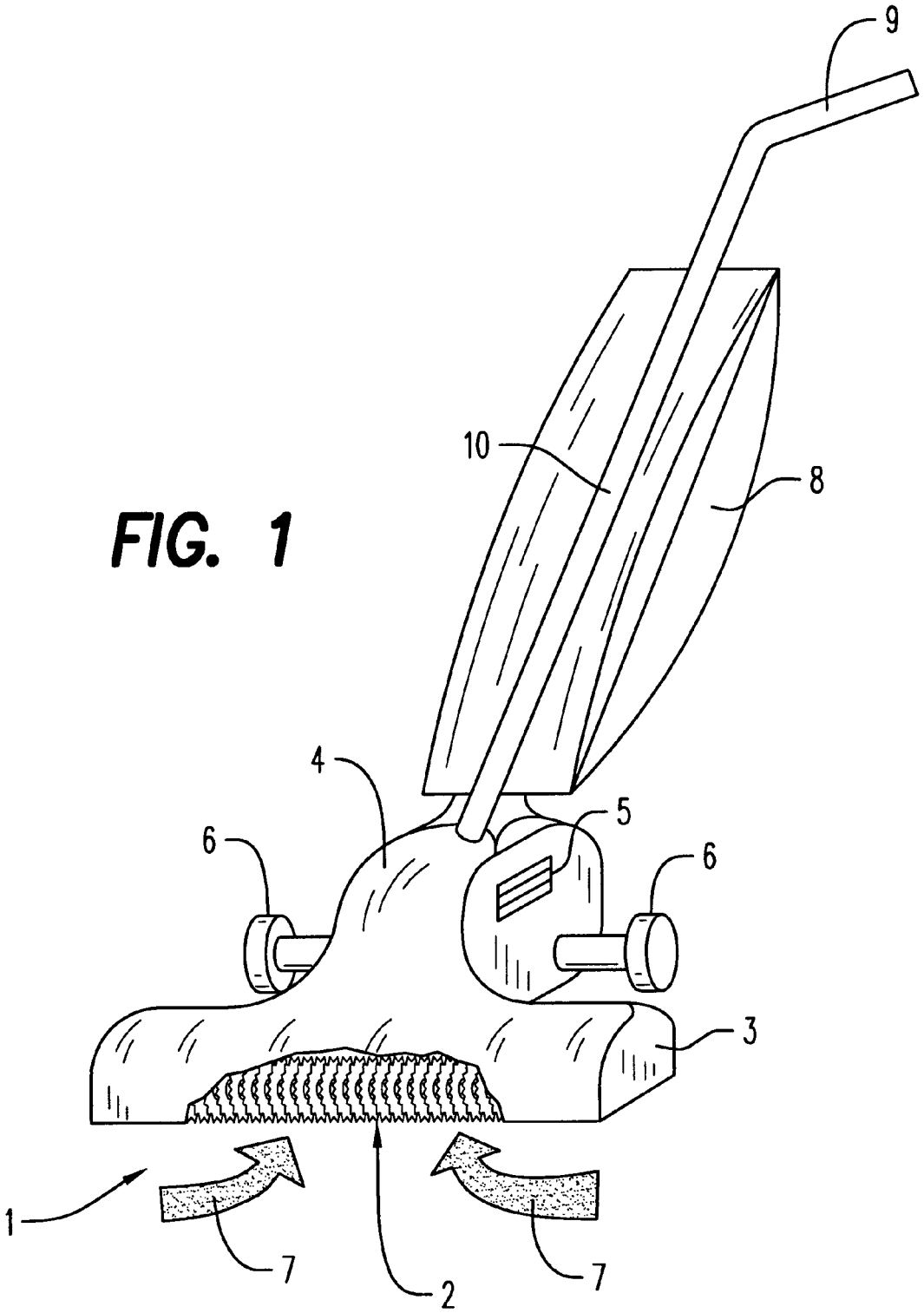
FIG. 1 is a perspective broken view of a carpet vacuum cleaning machine showing the spurshank apparatus which replaces the conventional motor driven roller brush of the vacuum cleaning machine.

Referring now to FIG. 1, a vacuum carpet cleaning machine including the present invention for vacuuming debris deep below the surface of a carpet or rug is shown generally at numeral 1. The carpet cleaning machine 1 generally comprises a roller brush housing 3, a spurshank apparatus 2, a vacuum motor 4, and a filter bag 8. Such conventional vacuum carpet cleaning machines such as 1 also include a vacuum motor housing 5, wheels 6, handle support member 10 and supporting handle 9.

The spurshank apparatus 2 generally replaces the elongated cylindrical roller type brushes used in many conventional vacuum cleaning machines, the spurshank 2 normally being located in the same location in the roller brush housing 3. It should be noted that the spurshank apparatus 2 may also be placed in a separate suction housing (not shown) thereby allowing a person to switch from conventional vacuuming with roller brushes to using the spurshank apparatus 2 to vacuum deep beneath the surface of the carpet or combinations of both. The spurshank apparatus 2 is normally made of metal but could possibly be made of a high impact plastic material. In operation, debris loosened from the carpet by the spurshank apparatus 2 is drawn into the roller brush housing 3 in the direction of arrows 7.

Figure 2:
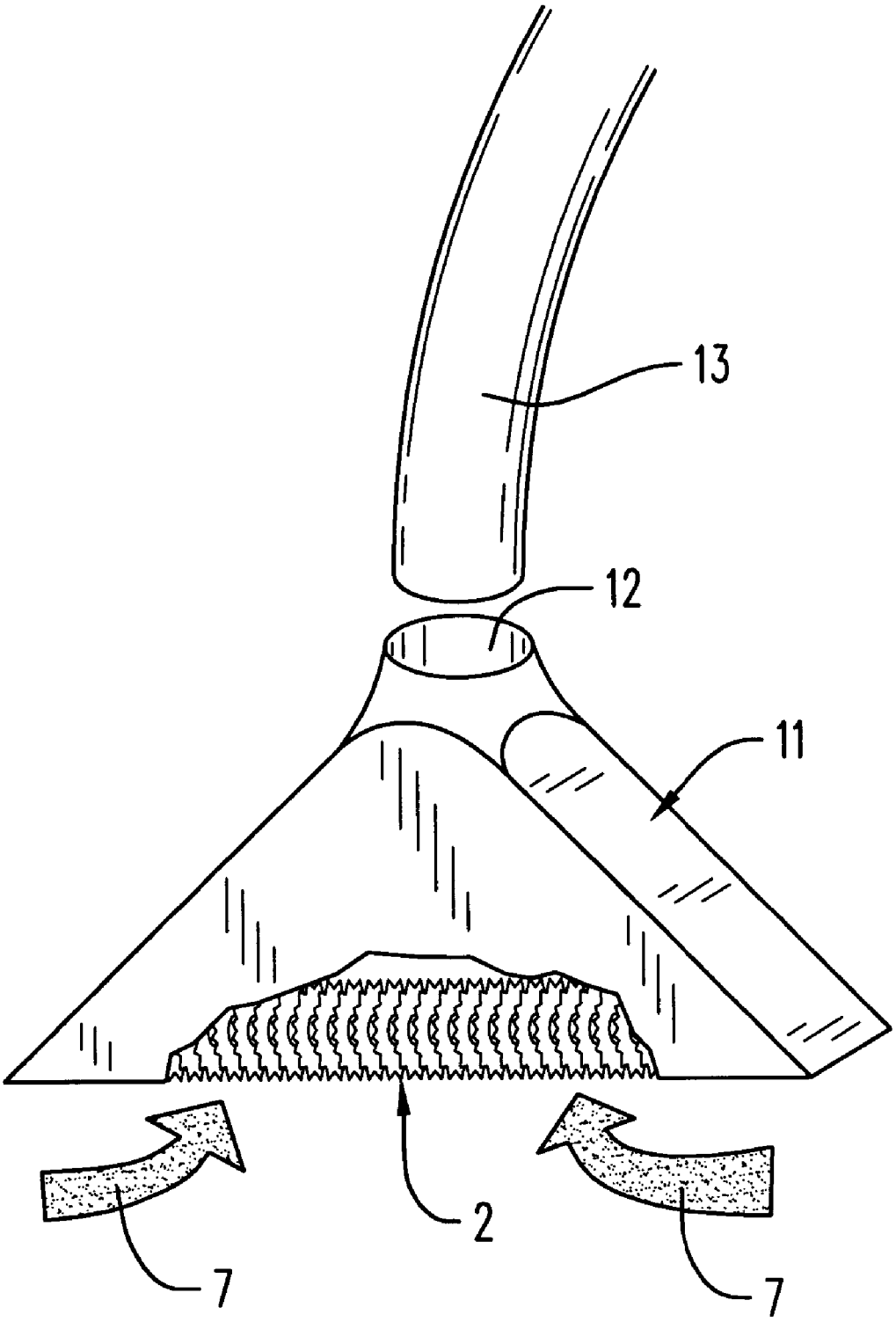
FIG. 2 shows a perspective broken view of the invention showing a vacuum head attachment having the spurshank apparatus built thereinto.

In FIG. 2, a vacuum head attachment is shown generally at numeral 11 and includes the spurshank apparatus 2 installed therein. The vacuum head attachment 11 includes a hose attachment opening 12 for affixing to a vacuum hose 13. In operation, the spurshank 2, manually rotated by pushing or pulling the vacuum head attachment 11 over the carpet, engages the carpet and penetrates deep beneath the surface of the carpet while spreading the-carpet fibers to expose dirt and debris deep beneath the carpet's surface. Once the dirt is exposed, the vacuum suction in the direction of arrows 7 is much better able to lift the dirt from the carpet to filter and/or store it appropriately. It should be noted that a spring or height adjusting mechanism can easily be incorporated in a well-known manner along with the spurshank apparatus 2 for carpets of varying thickness and depth.

Figure 3:
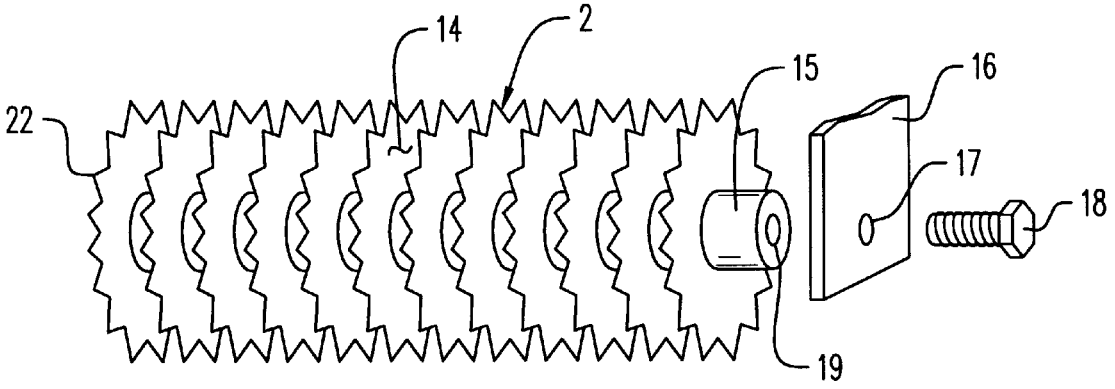
FIG. 3 shows a perspective view of the spurshank apparatus and a typical bracket assembly for attachment to the vacuum cleaning machine.
Figure 4:
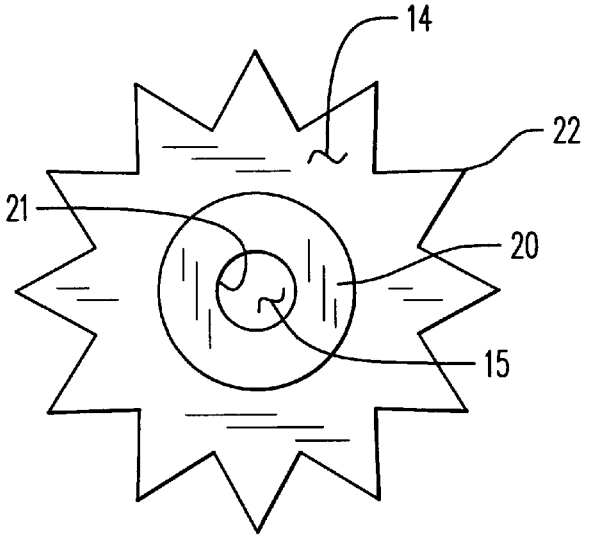
FIG. 4 shows a front view of a single star-shaped or spurred disc of the spurshank apparatus.

Referring now to FIGS. 3 and 4, a perspective view of the spurshank apparatus 2 and support bracket 16 are there shown. The spurshank apparatus 2 includes multiple rows of star-shaped or spurred disks 14 each having a plurality of pointed spurs 22 along the perimeter of the spur disk 14. The bracket 16 has an opening 17 for allowing a bolt 18 to fit therein. An elongated support shaft 15 extends through alternately arranged spacer washers 20 and apertures 21 of each of the multiple discs 14 to form multiple rows of spaced apart and freely spinning spur discs 14. At each end of rod 15 is a threaded cavity 19 for allowing a bolt 18 to affix the rod 15 to the bracket 16. The bracket 16 is normally an integral part of either the vacuum brush housing 3 or vacuum head attachment housing 11.

In carrying out this invention in the illustrative embodiment thereof, a person simply rolls spurshank apparatus 2 along the carpet within the vacuum head attachment. The spurshank apparatus 2 will engage and penetrate deep beneath the surface of the carpet spreading the nap of the carpet and exposing the dirt and debris beneath the carpet's surface. The vacuum action of the vacuum cleaning machine will simultaneously lift up the loosened and/or exposed dirt and trap it in the filter bag 8. Accordingly, a very unique, attractive, and convenient carpet vacuum cleaning machine is provided for vacuuming dirt and debris from deep below the surface of a carpet using a conventional vacuum cleaning machine and the spurshank apparatus.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A vacuum carpet cleaning machine for extracting dirt and debris from on and below the surface level of carpet comprising:

a vacuum carpet cleaner having a vacuum housing and a vacuum motor;

a plurality of somewhat star-shaped spur discs each having spaced sharpened radially extending points defining an outer periphery thereof and mounted for substantially free rotation on an elongated support shaft mounted in said vacuum housing, each said spur disc engaging and penetrating into a carpet, said points of said spur discs separating the fibers of said carpet exposing dirt deep below said fibers of said carpet thereby allowing said dirt to be extracted by said vacuum carpet cleaner.

2. A roller attachment apparatus for a vacuum head of a carpet vacuum cleaning machine which includes a vacuum source operably connected to the vacuum head, said apparatus comprising:

a plurality of somewhat star-shaped spur discs each having spaced radially extending points defining an outer periphery thereof and mounted for substantially free rotation on an elongated support shaft connectable in the vacuum housing, each said spur disc engaging and penetrating into a carpet, said points of said discs separating the fibers of said carpet exposing dirt deep below said fibers of said carpet thereby allowing said dirt to be extracted by the vacuum carpet cleaner.

* * * * *